United States Patent [19]

Mochizuki et al.

[11] 4,310,238

[45] Jan. 12, 1982

[54] ELECTROSTATIC COPYING APPARATUS

[75] Inventors: Manabu Mochizuki; Seiichi Miyakawa; Taro Kimura; Junichiro Hashimoto, all of Tokyo, Japan

[73] Assignee: Ricoh Company, Ltd., Tokyo, Japan

[21] Appl. No.: 181,609

[22] Filed: Aug. 27, 1980

[30] Foreign Application Priority Data

Sep. 8, 1979 [JP] Japan ..... 54-115555
Dec. 3, 1979 [JP] Japan ..... 54-156529

[51] Int. Cl.[3] ..... G03G 15/00

[52] U.S. Cl. ..... 355/14 D; 118/689; 222/DIG. 1; 355/10

[58] Field of Search ..... 355/14 D, 10, 3 DD; 118/688, 689, 691, 659, 660, 662; 222/DIG. 1, 52, 56; 430/117-119

[56] References Cited

U.S. PATENT DOCUMENTS

| | | | |
|---|---|---|---|
| 3,233,781 | 2/1966 | Grubbs | 355/14 D |
| 3,369,524 | 2/1968 | Führer | 355/10 X |
| 3,572,551 | 3/1971 | Gillespie et al. | 222/DIG. 1 |
| 3,674,353 | 7/1972 | Trachtenberg | 355/10 X |
| 3,712,203 | 1/1973 | Kishi et al. | 355/10 X |
| 3,830,401 | 8/1974 | Benwood et al. | 222/DIG. 1 |
| 3,870,197 | 3/1975 | Landrith | 222/DIG. 1 |
| 3,876,106 | 4/1975 | Powell et al. | 355/14 D |
| 3,910,459 | 10/1975 | Bock et al. | 222/DIG. 1 |
| 3,932,034 | 1/1976 | Takahashi | 118/689 |
| 4,043,293 | 8/1977 | Ruckdeschel | 222/DIG. 1 |
| 4,222,497 | 9/1980 | Lloyd et al. | 222/DIG. 1 |
| 4,226,525 | 10/1980 | Sakamoto et al. | 355/14 D |

*Primary Examiner*—R. L. Moses
*Attorney, Agent, or Firm*—David G. Alexander

[57] ABSTRACT

First and second sensors (37), (39) are provided in a developing tank (36) containing a liquid developer consisting of a liquid carrier or dispersant and toner particles dispersed in the carrier. The first sensor (37) measures the electrical resistivity of the developer whereas the second sensor (39) measures the optical transmissibility thereof. Additional toner is supplied into the developer to maintain the transmissivity at a value which is a predetermined function of the resistivity. The transmissibility value is reduced as the resistivity increases, thereby maintaining the copy image density constant. The first sensor (37) includes two electrodes immersed in the developer and an A.C. or D.C. voltage is applied thereacross. The current flow through the electrodes (37) and thereby the developer is measured to determine the resistivity of the developer. Where the applied voltage is D.C., an arrangement is provided to mechanically scrape accumulated developer off the electrodes (37) at intermittent intervals.

13 Claims, 28 Drawing Figures

ELECTROSTATIC COPYING APPARATUS

BACKGROUND OF THE INVENTION

The present invention relates to an electrostatic copying apparatus utilizing a liquid developer and comprising means for automatically maintaining the copying image density constant.

A liquid developer used for electrostatic copying comprises a liquid carrier or dispersant and toner particles dispersed in the carrier. Only the toner particles are consumed in the developing process. Additional toner is supplied into the developer to compensate for the toner consumed in the developing process.

Various means have been proposed to maintain the copying image density constant such as sensing the toner density and maintaining the same constant. However, such an arrangement results in progressively decreasing copying image density due to fatigue of the toner and contamination of the carrier occuring over a period of time.

SUMMARY OF THE INVENTION

An electrostatic copying apparatus embodying the present invention includes container means for containing a liquid developer having a liquid carrier and toner particles dispersed in the carrier, and is characterized by comprising first sensor means for sensing an electrical resistivity of the developer, second sensor means for sensing an optical transmissibility of the developer, supply means for supplying additional toner particles into the developer, and control means responsive to the first and second sensor means for controlling the supply means to supply additional toner into the developer in such a manner as to maintain the transmissibility at a value which is a predetermined function of the resistivity.

In accordance with the present invention, first and second sensors are provided in a developing tank containing a liquid developer consisting of a liquid carrier or dispersant and toner particles dispersed in the carrier. The first sensor measures the electrical resistivity of the developer whereas the second sensor measures the optical transmissibility thereof. Additional toner is supplied into the developer to maintain the transmissivity at a value which is a predetermined function of the resistivity. The transmissibility value is reduced as the resistivity increases, thereby maintaining the copy image density constant. The first sensor includes two electrodes immersed in the developer and an A.C. or D.C. voltage is applied thereacross. The current flow through the electrodes and thereby the developer is measured to determine the resistivity of the developer. Where the applied voltage is D.C., an arrangement is provided to mechanically scrape accumulated developer off the electrodes at intermittent intervals.

It is an object of the present invention to provide an electrostatic copying apparatus including means for effectively maintaining a copying image density constant.

It is another object of the present invention to provide an electrostatic copying apparatus which provides consistently excellent copies over a prolonged period of use in an automatic manner.

It is another object of the present invention to provide a generally improved electrostatic copying apparatus.

Other objects, together with the foregoing, are attained in the embodiments described in the following description and illustrated in the accompanying drawing.

DESCRIPTION OF THE PREFERRED EMBODIMENTS

While the electrostatic copying apparatus of the present invention is susceptible of numerous physical embodiments, depending upon the environment and requirements of use, substantial numbers of the herein shown and described embodiments have been made, tested and used, and all have performed in an eminently satisfactory manner.

A known copying image density control method employs a photosensor and controls the density of a developing liquid by measuring the transmissibility with the photosensor. A problem involved in this control method is that a constant toner density is not always reflected by a constant density of reproduced images because repeated copying cycles cause the resistance of the carrier liquid of the developer to decrease progressively.

Another prior art method is designed to apply an AC voltage across electrodes and control the developer density according to the current which flows through the developer. This is not fully acceptable in that the toner density and therefore the image density progressively decreases with the decrease in the resistivity of the carrier liquid.

The present invention is adapted to maintain the image density constant by varying the control transmissibility of the carrier liquid.

Figure 1:
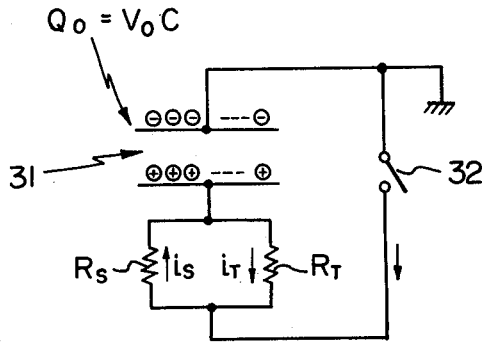
FIG. 1 is a diagram for explaining the principle of the present invention.

Generally, a developing process for electrostatic copying may be represented by the equivalent circuit shown in FIG. 1. In FIG. 1, $Q_0$ denotes the amount of charge on a photosensitive element 31, C the capacitance of the photosensitive element 31, $V_0$ the charge potential on the element 31, $R_T$ the resistance of a toner of a liquid developer, and $R_S$ the resistance of the carrier liquid. The amount of development will be expressed as follows as a charge amount $Q_T$ allowed to pass through a resistance R when a switch 32 is closed for t seconds:

$$Q=CV \qquad Eq.\ (1)$$

$$Q=Q_0-\int idt \qquad Eq.\ (2)$$

$$i=V/R \qquad Eq.\ (3)$$

where Q indicates the charge deposited on the photosensitive element 31 after t seconds, V its potential and i the current flowing through the circuit.

These Eqs. (2) and (3) give the current i as $$i=-V_0/R\cdot e-(t/RC) \qquad Eq.\ (4)$$

where $R=(R_S\cdot R_T)/(R_S+R_T)$. Therefore, the current $i_T$ flowing through the resistance $R_T$ is expressed as $$i_T=-V_0/R_T e-(t/RC) \qquad Eq.\ (5)$$

Then the charge $Q_T$ which flows through the resistance $R_T$ is obtained as $$Q_T=\int_0^T i_T dt=\frac{R_S}{R_T+R_S}\cdot C\cdot V_0\left\{\exp\left(-\frac{T}{\frac{R_T\cdot R_S}{R_T+R_S}C}\right)-1\right\} \qquad Eq.\ (6)$$

It will be understood from Eq. (6) that, since the capacitance C, charge potential $V_0$ and developing time t are usually constant, the charge $Q_T$ and, therefore, the amount M of toner deposition will remain constant if the resistance $R_S$ and $R_T$ are kept constant. In this situation, the density of the reproduced image will be constant. Experiments have shown, however, that the resistance $R_S$ progressively decreases as the copying cycle is repeated.

This decrease in the resistance is brought about partly by melting into the carrier of part of the resin constituing the toner and partly by mixing of the processing material (sizing compound) on paper sheets into the developer, which in combination lowers the resistance of the carrier.

Meanwhile, the toner density in the developer is maintained at a constant level by a device usually referred to as a toner density sensor, and the resistance $R_T$ remains constant. Thus, as will also be seen from Eq. (6), the decrease in the charge $Q_T$ causes a reduction of the image density as the number of copies increases.

With this in view, the present invention contemplates to hold the ratio $R_S/(R_T+R_S)$ constant by varying the resistance $R_T$ according to the fluctuating resistance $R_S$. It has been a common practice to determine the resistance $R_T$ by measuring a current flowing across the electrodes provided by a DC power source. With this method, however, toner particles will be electrically deposited or the electrodes during each measurement and make the electrodes incapable of another measurement unless they are cleaned. The present invention therefore determines the toner density by measuring the transmissibility of the liquid developer. This principle is based on the relations:

$$\text{resistance } T_T\ \alpha\ \frac{1}{\text{toner density}}$$

and $$\text{transmissibility } \alpha\ \frac{1}{\text{toner density}}$$

The resistance $R_S$ on the other hand can be determined by applying an AC voltage across the electrodes and measuring the current which will flow therethrough.

Figure 2:
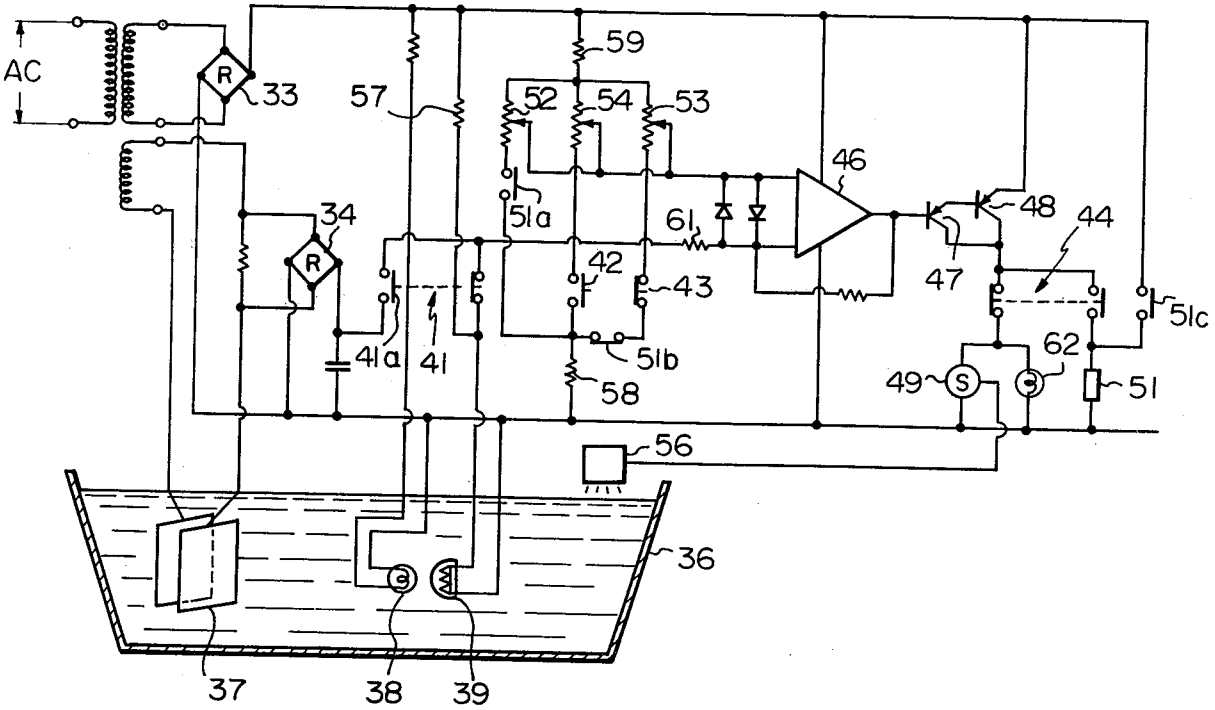
FIG. 2 is an electrical schematic diagram of a first embodiment of the present invention.

An electric circuit for practicing the present invention will be described with reference to FIG. 2. As shown, the circuit includes first and second rectifiers 33 and 34 each adapted to convert an AC current into a DC current. The reference numeral 36 denotes a container of liquid developer in which is immersed a pair of plate electrodes 37, a lamp 38 energized by the DC output of the rectifier 33 and a CdS element or photoelectric transducer 39 receiving light transmitted through the developer from the lamp 38. The circuit also includes change-over switches 41 to 44 operated together in response to control signals, an operational amplifier 46, transistors 47 and 48 connected to the operational amplifier 46 in a Darlington arrangement to actuate a solenoid 49 and a relay 51, variable resistors 52 and 53 for controlling the density level of the developer and a variable resistor 54 for determining the resistance of the developer.

The switch 41 is adapted to change over the sensors, the switches 42 and 43 are employed to alter the reference level, and the switch 44 is for selectively activating a toner supply device 56 and a liquid density selecting device. The relay 51 has a set of relay contacts **51*a* to 51*c***.

In this circuit arrangement, the operational amplifier 46 is switched over by the switch 41 for the measurement of liquid resistivity and optical density. Whenever power is turned on, the circuit starts its operation from the first level and constantly compares an instantaneous level with the initially set level, when the switch 41 is in the state shown in FIG. 2, the lamp 38 is turned on and the amount of light transmitted through the developer is detected by the CdS element 39. The operational amplifier 46 is supplied with the bridge equilibrium voltage of a resistor 57 and the resistance of the CdS element 39 and a resistor 58 and variable resistor 53 and a resistor 59 and variable resistor 53. When the switch 41 is in the opposite state, the CdS element 39 is switched out and the AC voltage provided by the measurement of the liquid resistivity through the electrodes 37 is coupled to the operational amplifier 46 via a switch contact **41*a* and a resistor 61 after being rectified by the rectifier 34 and compared thereby with the reference value determined by the variable resistors 52 to 54. During measurement of the liquid optical density, the contacts of the individual switches 41 to 44 are set as illustrated in FIG. 2. When under this condition the operational amplifier 46 produces an operation signal, the transistors 47 and 48 in Darlington connection are activated to drive the solenoid 49 and turn on the lamp 62. A reference level at this time is determined by the variable resistor 53. Upon energization of the solenoid 49, the toner supply device 56 is energized to supply toner to the developer. As the density of the developer increases due to the supply of toner, the output of the operational amplifier 46 goes off and the solenoid 49 becomes nonconductive with the lamp 62** turned off. The density of the developer is controlled in this way.

During measurement of the liquid resistivity, all of the switches 41 to 44 have their contacts changed over to the opposite state so that the reference level at the operational amplifier 46 is determined not by the variable resistor 53 but by the variable resistor 54. When an operation signal appears at the output terminal of the operational amplifier 46, the transistors 47 and 48 are turned on to drive the relay 51 which is latched on through its contact 51*c*. At the same time, the contact 51*a* of the relay 51 is closed to set the reference level of the operational amplifier 46 to a lower level determined by the combination of the variable resistors 52 and 54. The relay contact 51*b* remains open. Accordingly, when the switches 41 to 44 are changed over to the illustrated positions for another measurement of the liquid density, the solenoid 49 will be immediately energized to supply toner and thereby increase the liquid density. In this manner, the copy density can be controlled effectively by operating the change-over switches 41 to 44 at the start of copying operation.

Figure 4:
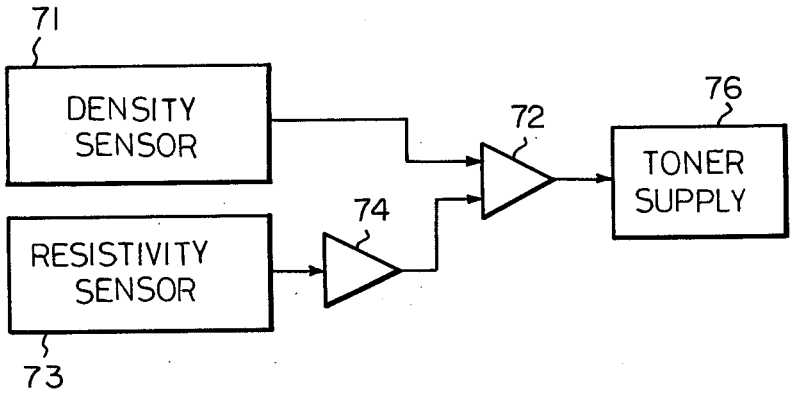
FIG. 4 is a block diagram of another embodiment of the invention.

FIG. 4 shows another circuit arrangement according to the present invention. As illustrated, the output of a liquid density sensor 71 is coupled to one input terminal of an operational amplifier 72 while the output of a liquid resistivity sensor 73 is applied through an amplifier 74 to the other or reference input terminal of the operational amplifier 72, the output of the amplifier 72 is in turn coupled to a toner supply circuit 76 for supplying a supplementary amount of toner. With this circuitry, the liquid density can be controlled in a full automatic fashion.

Figure 3:
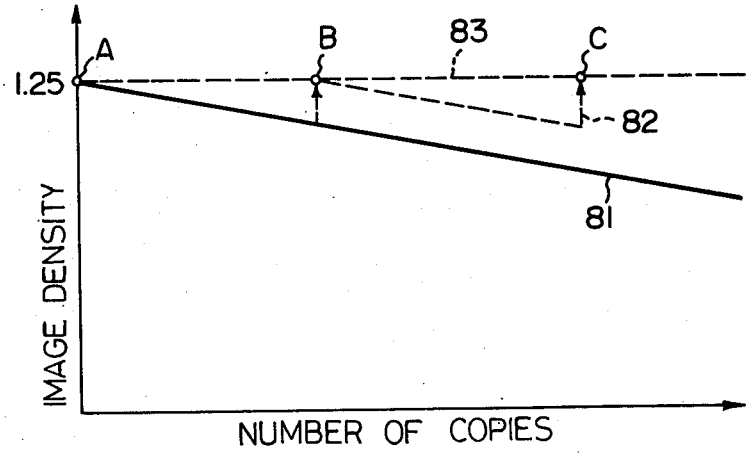
FIG. 3 is a graph illustrating the operation of the invention.

FIG. 3 graphically shows the relationship between the image density and number of produced copies obtainable with a method of the present invention, in comparison with the same relation provided by a prior art method. In this graph, a solid line 81 which corresponds to the prior art was obtained with the transmissibility T kept constant at 22.5%. Lines 82 and 83 demonstrate the characteristics provided by the circuits of the invention depicted in FIGS. 2 and 4, respectively. At a point A, the transmissibility T is 25.5% and the measured carrier resistance $R_S$ is $2.2\times10^8$ ohms. At a point B, the tramsmissibility T is 16% and the carrier resistance $R_S$ is $1.94\times10^8$ ohms. At a point C, the transmissibility T is 8% and the carrier resistance $R_S$ is $1.62\times10^8$ ohms.

Figure 5:
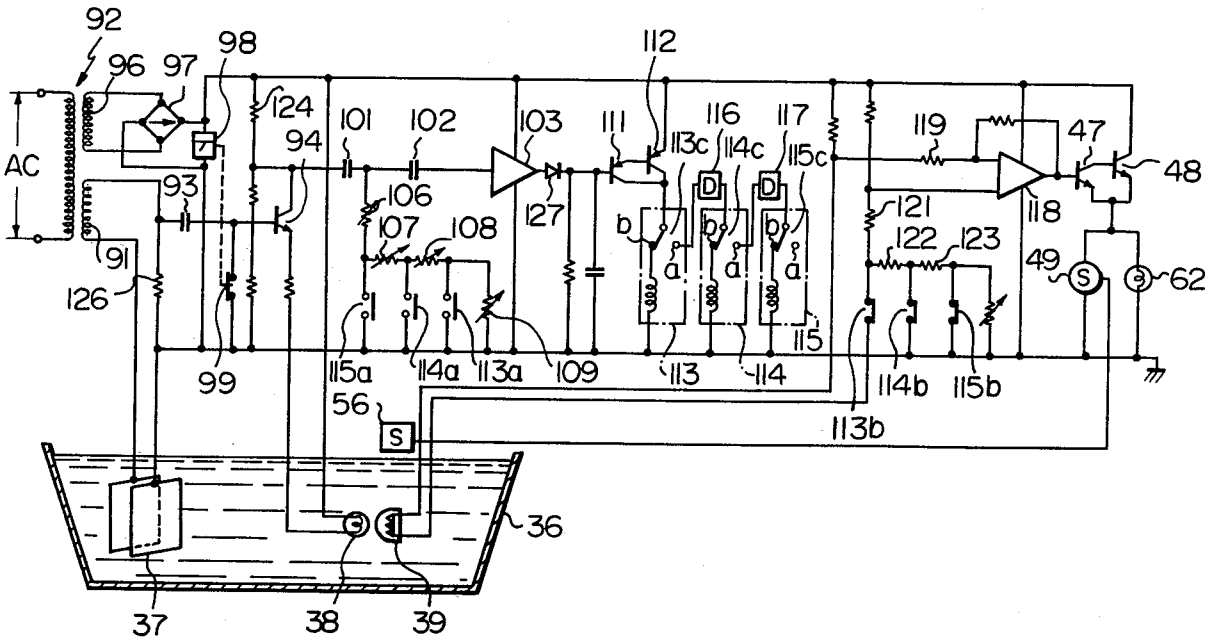
FIG. 5 is an electrical schematic diagram illustrating another embodiment of the invention.

FIG. 5 shows another circuit according to the present invention. As shown, AC power from a first secondary winding 91 of a transformer 92 is coupled to the plate electrodes 37 and, through a capacitor 93, to the base of a transistor 94. AC power from a second secondary winding 96 of the transformer 92 is converted into a DC power by a rectifier 97 and then coupled to a timer circuit 98. A contact 99 operated by the timer circuit 98 is connected in parallel between the base and emitter of the transistor 94. The collector output of the transistor 94 is applied via capacitors 101 and 102 to an amplifier 103 which has a threshold function. The junction between the capacitors 101 and 102 is grounded through variable resistors 106 to 109. The output of the amplifier 103 is coupled to transistors 111 and 112 which are in Darlington connection so that the amplified output drives keep relays 113 to 115. When a contact 113*c* of the keep relay 113 shifts from the b side to the a side, the keep relay 114 is driven through a delay circuit 116 whereupon a contact 114*c* of the keep relay 114 changes from the b side to the a side to drive the keep relay 115 through a delay circuit 117. The keep relays 113 to 115 have make contacts 113*a* to 115*a* and break contacts 113*b* to 115*b*. The CdS element 39 has one end grounded and the other end connected to an operational amplifier 118 via resistor 119. The output of the operational amplifier 118 is adapted to operate the solenoid 49 and lamp 62 through the transistors 47 and 48 in Darlington connection.

The timer circuit 98 is designed, for example, to operate for 5 seconds at 10 minute intervals so as to open the contact 99. While the contact 99 is closed, the amplifier 103, keep relays 113 to 115 and the like remain inoperative because the base of the transistor 94 is grounded. Even when the contact 99 is closed, the liquid density sensing system is operated. As the liquid density becomes lower than a reference level (determined by variable resistors 121 to 123), the solenoid 49 is energized through the operational amplifier 118 and transistors 47 and 48 to energize the device 56 to supply toner into the developer. When the contact 99 is open, a signal indicating liquid resistance detected by the electrodes 37 is applied to the amplifier 103. More specifically, the input of the amplifier 103 corresponds to the resistance signal divided by a resistor 124 and variable resistors 107 to 109. Hence, the amplifier 103 becomes operative when the input level rises beyond a predetermined threshold level (time $t_1$ in FIG. 6). An increase in the density of the developer is reflected by an increase in in the magnitude of the current flowing across the electrodes 37 and thus an increase in the voltage across a resistor 126. When the amplifier 103 is activated to produce an output signal, the keep relay 113 is driven through a diode 127 and transistors 111 and 112 to have its contact 113*c* changed from the b side to the a side, its make contact 113*a* closed and its break contact 113*b* opened. The contact 113*a* which is closed shorts the variable resistor 109 whereby the input level of the amplifier 103 is lowered and the keep relay 113 is deactivated. The keep relay 113 once driven holds its state (contact a) while the keep relay 114 remains inoperative due to the delay circuit 116 preceding the keep relay 114. Opening of the contact 113*b* increases the voltage division level of the operational amplifier 118 and turns off the solenoid 49.

When the input signal level exceeds the threshold level of the amplifier 103 (time $t_2$ in FIG. 6) and when the timer circuit 98 is operated (opening the contact 99) upon the lapse of another time period from the abovementioned condition, the relay 114 is driven through the contact 113*c* and delay circuit 116 to shift the contact 114*c* from the b side to the a side, close its make contact 114*a* and open its break contact 114*b*. Then, in the manner described, toner is supplied into the developer until the input signal level of the amplifier 103 is lowered with the reference level of the operational amplifier 18 raised, interrupting the toner supply. The same will occur when the keep relay 115 is driven (time $t_3$ in FIG. 6) in a later stage.

Thus, according to the embodiment of FIG. 5, toner can be supplemented on the basis of a predetermined program at times $t_1$, $t_2$ and $t_3$ (which correspond to the number of copies). This allows the transmissibility of the liquid to decrease and therefore promotes the control of the image density to a substantially constant level.

Figure 6:
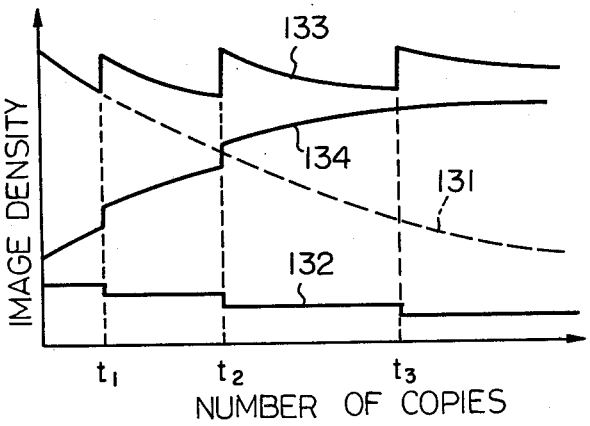
FIG. 6 is a graph illustrating the operation of the embodiment of FIG. 5.

Curves in FIG. 6 demonstrate characteristics obtainable with the prior art and the present invention. Curve 131 shows the relationship between the image density and number of copies provided by the prior art. Curve 132 indicates the relationship between the transmissibility and number of copies which represents the liquid density. Curve 133 indicates an image density characteristic obtainable with the present invention. Curve 134 shows the characteristic of a current flowing through the electrodes 37. This plot of FIG. 6 is based on the assumption that the programmed operating points are the times $t_1$, $t_2$ and $t_3$ by way of example (the times can correspond to the number of copies). It will be seen that the image density can be controlled to a substantially constant level in accordance with the present invention.

It will be noted that the keep relays and delay circuits employed in the illustrated embodiment for setting a program may be replaced by a microcomputer. Also, the amplifier 103 with a threshold function may be replaced by the combination of an amplifier and a known Schmitt circuit, which will promote more positive operation.

In summary, the present invention is designed to control the liquid density according to a predetermined function of liquid resistivity and liquid transmissibility. Therefore, it overcomes irregularity dependent on the operating conditions, which might otherwise occur where the image density is controlled on the basis of the number of copies, and eliminates the need for periodic inspection of the developer and exchange of the liquid or like maintenance.

A process for developing electrostatic latent images on a photosensitive element in a copying machine of the type described is generally available in two types: a dry process and a semimoist process. A process of the semimoist type uses a liquid developer which comprises a dielectric dispersion medium (dispersant) or so-called mother liquor or carrier containing toner particles usually charged to the opposite polarity of latent images. When such a developer composition is supplied to a photosensitive element formed with an electrostatic latent image, the toner particles in the liquid undergo electrophoresis due to attraction by the charge of the latent image and adhere to the latent image to thereby develop the same.

The conditions of the developer must be maintained within a certain allowable range in order that the quality, particularly density, of the reproduced image may remain favorable.

Of the conditions of the developer, what is most important is the toner density of the developer which directly affects the density of the processed visible image.

In a conventional copying machine of the semimoist process type, the toner density in the developer is generally controlled by detecting the toner density through the optical transmissibility of the developer and maintaining the transmissibility within a predetermined range. However, the image density of the visible image progressively decreases after a prolonged period of time despite such toner density control. This is attributable to a phenomenon called fatigue of the developer. Therefore, the quality of the visible image cannot remain stable over a long time unless the conditions of the developer are controlled in due consideration of the fatigue of the developer in addition to the toner density.

To know the fatigue of the developer, the fatigue must be measured in one form or another. Of various measurable parameters of the developer, the electrodeposition current shows a behavior which well corresponds to the fatigue of the developer.

The electrodeposition current is a current which will flow across a pair of electrodes when the electrodes are immersed in a developer and applied with a constant voltage. The value of this current tends to increase with the fatigue of the developer.

This type of method, however, fails in accurate measurement over a long period of time. When a DC voltage is applied to the electrode pair, the electrodes become contaminated with deposited toner in accordance with time in the case of continuous measurement or with repeated measurement in the case of intermittent measurement, this contamination gives rise to an error in the result of the measurement.

To solve this problem, there has been proposed a method which measures the electrodeposition current while applying an AC voltage across the electrodes. This methods avoids deposition of toner particles on the plate electrodes by, during measurement, altering the polarity of the AC voltage at a rate higher than the speed of the toner arriving at the plate electrodes due to electrophoresis. Since, however, effective prevention of the toner deposition fails unless the AC voltage applied to the electrode pair has a very high frequency, the circuitry and, therefore, the measuring system itself has a disproportionate cost.

In a traditional semimoist process copying machine, the toner density in the developer is detected through the light transmissibility of the developer and the supplement of toner and carrier is so controlled as to keep the transmissibility within a certain range, thereby rendering the development stable. Since the supply of supplementary carrier is auxiliary to that of toner particles, the following description will proceed on the assumption that the development consumes the toner particles alone for convenience. This assumption is acceptable since it does not affect the generality of the description and since the present invention requires no modification of the existing method in regard to the supplement of carrier.

The toner replacement on the basis of the phototransmissibility will be outlined hereinafter.

A liquid developer is circulated through a photosensor under specific conditions to have its transmissibility measured. It is possible to determine a range of transmissibility offering desirable visible images by changing the toner density in the developer to various values while maintaining the measuring conditions the same and developing latent images with such toner densities. Let it be assumed that the transmissibility range is defined by an upper limit $H_T$ and a lower limit $L_T$. With this transmissibility range, the toner density control will proceed as follows.

Figure 11:
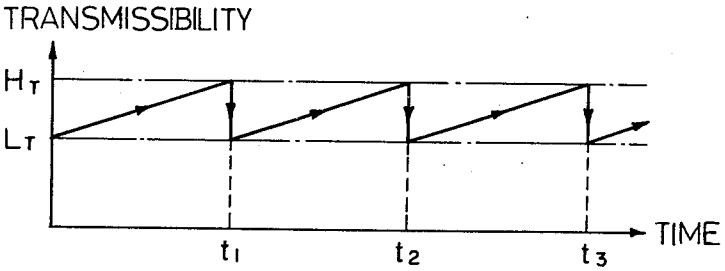
FIGS. 11, 12, 13, 14, 15, 16, and 17 are graphs illustrating the operation of the invention.
Figure 12:
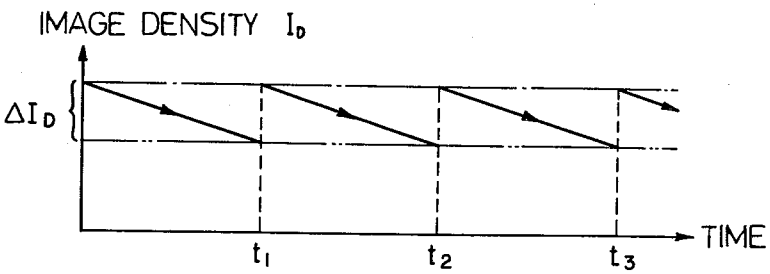

A control mechanism preset with the upper and lower limits $H_T$ and $L_T$ actuates a toner supply device when the output of the sensor indicates a transmissibility over the upper limit $H_T$. When the transmissibility becomes lower than the lower limit $L_T$, the control mechanism stops toner supply. This holds the toner density in the developer within a proper range and therefore the image density in an adequate range. FIGS. 11 and 12 show the variation of the transmissibility of the developer thus controlled and the variation of the image density on a photosensitive element.

In FIGS. 11 and 12, the abscissa t indicates time (copying time period) and, in FIG. 12, ID indicates the image density. ΔID in FIG. 12 represents a proper range of image density. On the absicca in each plot, $t_1$, $t_2$ and $t_3$ show times when toner is supplied. Though the toner supply in practice occurs over a certain period of time, it is illustrated as occurring instantaneously for the sake of convenience.

Such toner density control is quite effective and brings about hardly any problems in practical use as long as the copying cycles are repeated up to several thousands of times.

However, the following problem occurs when a copying cycle is repeated 20,000 times, 30,000 times, 50,000 times and more for example.

Figure 13:
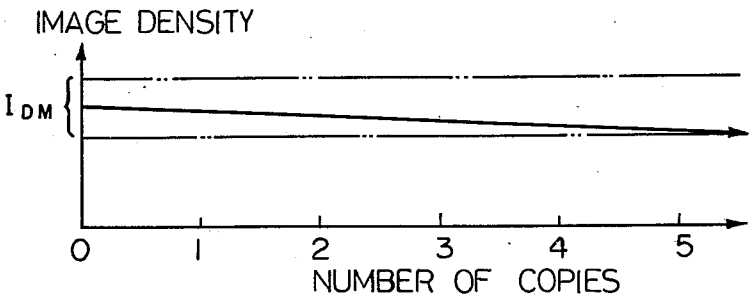

FIG. 13 is a plot showing the relationship between the number of repeated copying cycles and the mean image density between successive supplies of concentrated toner particles. This plot is based on development with a liquid developer which is controlled by the toner density control method discussed above. As shown, the mean image density denoted by IDM progressively decreases as the number of repeated copying cycles increases as to 20,000, 30,000, 50,000 etc. Finally, the developer fails to provide acceptable visible images despite the toner density control.

This problem is attributable to fatigue of the developer.

In a developer just prepared from a fresh toner and carrier, all of the toner particles can effectively be used in the development. Under this condition, there holds an equation $\rho_T=\rho_3$ where $\rho_T$ denotes the density of all the toner in the developer and $\rho_3$ the density of that part of the toner which can effectively contribute to the development. As the copying cycle is repeated, a part of the toner in the developer becomes incapable of contributing to the development due to damage, loss of charge, charging to the opposite polarity and the like. Assuming that this inoperative part of the toner has a density $\rho_u$, the density of the entire toner $\rho_T$ is expressed as $\rho_T=\rho_e+\rho_u$. The toner density $\rho_u$ simply increases with the number of copying cycles repeated.

To more clearly point out the problem concerned here, suppose that the toner density in the developer is kept at a constant level by performing the measurement of phototransmissibility of the developer and the supplement of the toner without intermission.

Assuming the toner density detected by the measurement of the transmissibility is $\rho_T$ or $\rho_e+\rho_u$, the above-mentioned toner density control is nothing but a control for making the ratio $d\rho_T/dt$ zero, where t is the time which lapses with the repeated number of copying cycles. Since $\rho_T=\rho_e\rho_u$, the above relation implies $d\rho_e/dt+d\rho_u/dt=0$. Because $\rho_u$ simply increases with time t, there holds a relation $d\rho_u/Dt>0$ and therefore $d\rho_e/dt>0$. This means that, as long as the toner density control proceeds on the basis of the phototransmissibility of the developer, the effective toner density $\rho_e$ in the developer decreases progressively. With this, the mean image density IDM of the visible image also falls.

Figure 14:
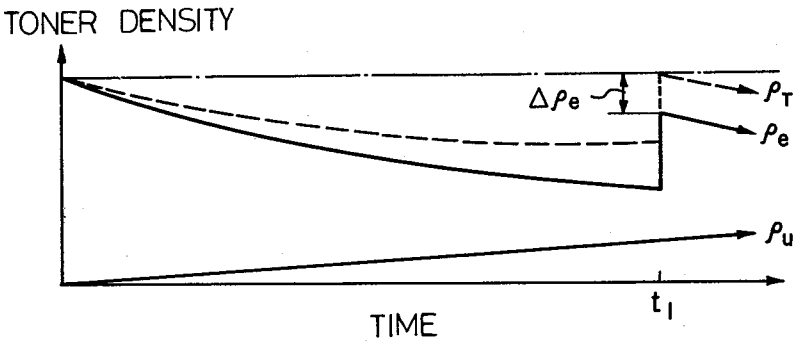

The fact stated above in connection with continuous toner supply holds true also for intermittent toner replenishment. As demonstrated in FIG. 14, the ineffective toner density which is $\rho_u=0$ in the just prepared developer (t=0) progressively increases with the lapse of time or number of repeated copying cycles while the effective toner density $\rho_e$ progressively decreases due to development. That is, for $t>0$, $\rho_T=\rho_e+\rho_u$ holds. A supplementary volume of toner is supplied at time $t_1$. However, this supplement is controlled on the basis of the phototransmissibility so that the effective toner density is lower than that at the time t=0 by a proportion $\Delta\rho_e$ which is equal to the value $\rho_u(t_1)$ of the density $\rho_u$ at time $t_1$. In this way, the developing ability of the developer decreases progressively despite the supplement of the concentrated toner.

Thus, in order to preserve the stability of the developing ability of a developer, the fatigue of the developer must be additionally taken into account in the supply of concentrated toner.

Figure 15:
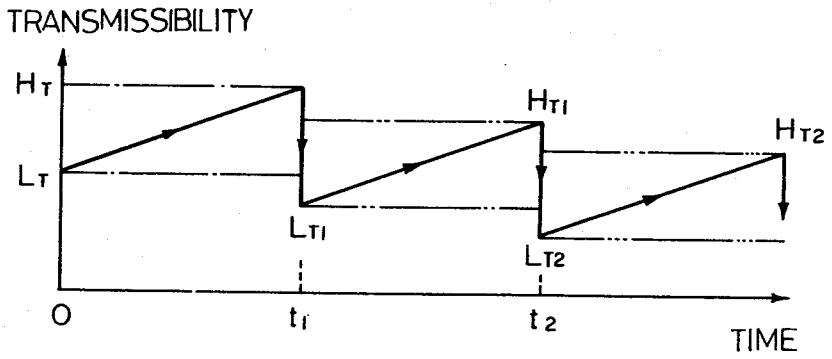
Figure 16:
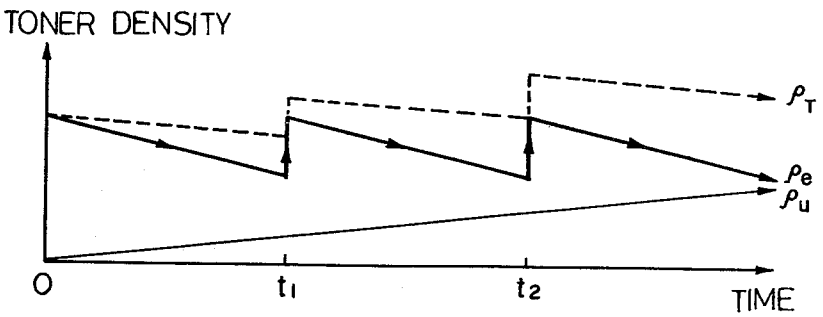
Figure 17:
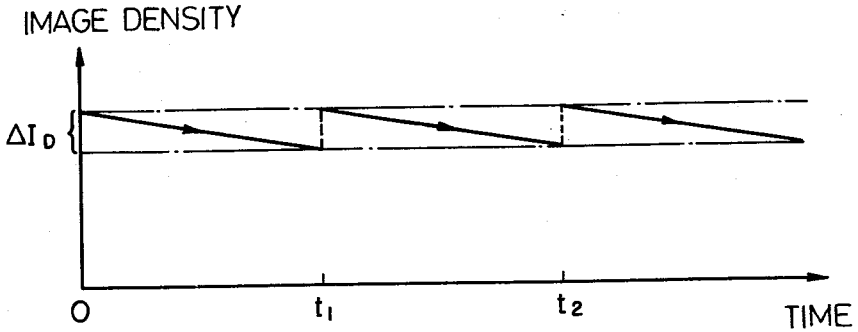

In principle, such supply of concentrated toner may be carried out as follows. As shown in FIG. 15, the optical transmissibility for the control of toner supplement first has a range having an upper limit $H_T$ and a lower limit $L_T$. At the time $t_1$, when concentrated toner is supplied, the lower and upper limits of the initially set range are lowered individually to $H_{T1}$ and $L_{T1}$. When another supplementary amount of toner is supplied at the time $t_2$, the allowable range is further lowered to one defined by an upper limit $H_{T2}$ and a lower limit $L_{T2}$. This procedure will be repeated thereafter. If the amount which the preset range is lowered at each supplement is so determined as to successfully cancel the increase in the density $\rho_u$, each supplement can maintain the effective toner density $\rho_e$ within the proper range (FIG. 16). However, as viewed in FIG. 16, the total toner density $\rho_T$ of the developer and the ineffective toner density $\rho_u$ progressively increase.

In practice, the rate of increase of the ineffective density $\rho_u$ is so low that re-setting of the transmissibility range need not be effected at every supplement but should only be performed once in every 5,000–10,000 copying cycles.

Now, to supply concentrated toner in consideration of the fatigue of the developer, the fatigue represented by an increase in the density $\rho_u$ must be measured in one form or another. Various experiments showed that, of various measurable parameters of the developing liquid, an electrodeposition current has a behavior which well corresponds to the fatigue of the developer.

The electrodeposition current in a developer is a current which flows through a pair of electrodes when the electrode pair is immersed in a developer at a given spacing and applied with a constant voltage thereacross. This current tends to increase with the fatigue of the developer.

With this in view, the following method will permit the toner supply to hold the developing ability of a developer within a predetermined range. The toner supplementing mechanism is designed such that a supplementary amount of toner is supplied to a developer when the transmissibility of the developer is varied a given amount which is the difference between the upper and lower limits of the present range. The electrodeposition current in the developer is measured as a qualitative value. Every time the electrodeposition current varies by a predetermined amount, the preset transmissibility range is lowered in accordance with the fatigue of the developer represented by the variation of the current. Alternatively, every time a predetermined number of copying cycles is reached, the preset transmissibility range may be lowered in accordance with the variation of the current.

The transmissibility control must be constantly performed during operation of the copying machine in relation with the toner replenishment as well. However, it is not always necessary to constantly measure the electrodeposition current. Even where the transmissibility range is re-set in response to each predetermined amount of change in the electrodeposition current, the measurement of the electrodeposition current need only be performed at an approximate rate of once per 50 copying cycles. Where the transmissibility range is reset according to the change in the current every time a predetermined number of copying cycles is reached, it will suffice to measure the current once in the predetermined number of copying cycles.

As well known, when a DC voltage is applied across electrodes for measuring the electrodeposition current, the electrodes become contaminated by toner particles deposited thereon and constitute a cause of error in the next measurement.

Figure 7:
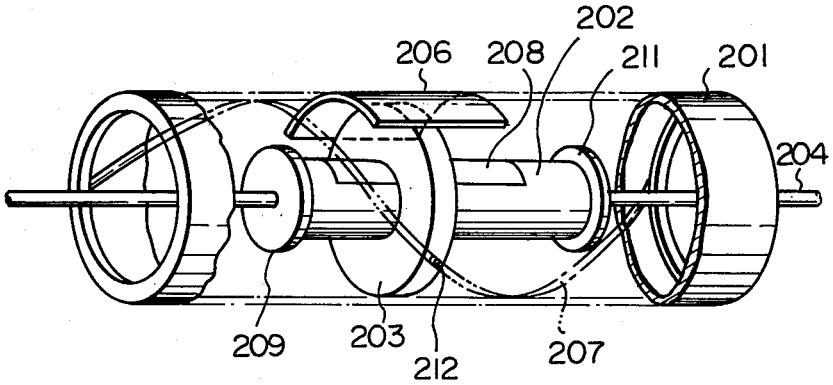
FIG. 7 is a cutaway perspective view of a sensor of the invention.

Referring to FIG. 7, an electrodeposition current or resistivity measuring sensor according to the present invention is shown to mainly consist of an outer tube or cylinder 201, an inner tube or cylinder 202, a slide or scraper ring 203 and a shaft 204.

The outer cylinder 201 is formed of plastic or the like electrically insulative material and has a bore therethrough. A part of the cylinder 201 is formed with an electroconductive plate 206 so that the inner peripheral surface of the cylinder 201 is electrically conductive at the plate 206. This conductive plate 206 will hereinafter be referred to as an electrode. The electrode 206 is connected to a power source at its surface contigous with the outer periphery of the cylinder 201.

The outer cylinder 201 has formed in its inner periphery a spiral guide groove 207.

The inner cylinder 202 is also formed of an electrically insulative material in a hollow shape and has a part of its wall formed with a conductive plate 208. Thus, the outer peripheral surface of the inner cylinder 202 is electrically conductive at the plate 208 which will be referred to as an electrode accordingly.

The inner cylinder 202 together with stops or flanges 209 and 211 secured to opposite ends thereof is mounted on the shaft 204 in coaxial relation with the outer cylinder 201. The positional relationship between the cylinders 201 and 202 is such that the electrodes 206 and 208 oppose each other in the positions shown in FIG. 7. The shaft 204 is electrically conductive and the electrode 208 on the inner cylinder 202 is connected to the power source through the shaft 204 in an area outside the inner periphery.

The outer cylinder 201 is securely mounted on a rigid member whereas the inner cylinder 202 is axially reciprocatable integrally with the shaft 204. The shaft 204 is connected at its one end with a drive mechanism though not shown. The slide ring 203 is slidably mounted on the inner cylinder 202 and has its inner periphery scrapingly engaged with the outer periphery of the cylinder 202 and its outer periphery scrapingly engaged with the inner periphery of the cylinder 201.

A pin 212 is studded on the outer periphery of the slide ring 203 and received in the guide groove or channel 207 of the outer cylinder 201.

Figure 8:
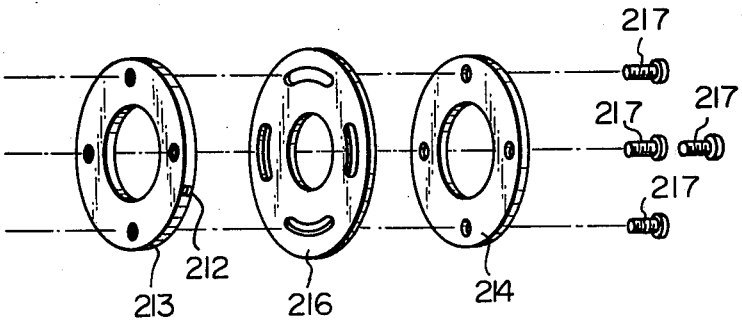
FIG. 8 is an exploded view of a scraper ring of the sensor.

A practical construction of the slide ring 203 is shown in FIG. 8. The slide ring 203 comprises a pair of annular discs 213 and 214 made of an insulative material such as resin and a thin elastic cleaning ring 216 made of an insulating material sandwiched between the annular discs 213 and 214. The rings 213, 214 and 216 are connected together by screws 217. The pin 212 protrudes radially outwardly from the disc 213.

The cleaning ring 216 has an inside diameter smaller than that of the discs 213 and 214 by about 1 mm and an outside diameter larger than that of the discs 213 and 214 by about 1 mm. Thus, the outer periphery of the inner cylinder 202 and innery periphery of the outer cylinder 201 are scrapingly engaged by the cleaning ring 216 of the slide ring assembly.

A typical example of a material for the cleaning ring 216 is rubber of MYLAR film (trade name).

The sensor having the above construction operates as follows for the measurement of the electrodeposition current.

FIGS. 9*a* to 9*e* show the sensor in fragmentary elevation for illustrating the operation.

Figure 9A:
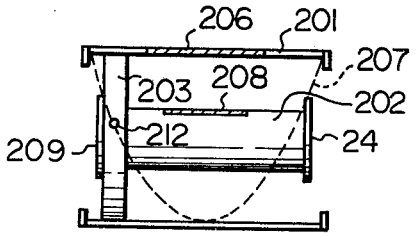
FIGS. 9*a*, 9*b*, 9*c*, 9*d*, and 9*e* are elevational views illustrating the operation of the sensor.

FIG. 9*a* indicates a home position of the sensor assembly in which the electrodes 206 and 206 face each other. This home position of the electrodes 206 and 208 represents a measuring position of the sensor. A D.C. constant voltage is applied to the electrodes 206 and 208. Naturally, the sensor in this situation is immersed in a developing liquid whose electrodeposition current is to be measured.

The voltage will be applied such that the electrode 206 has a polarity opposite to that of the toner. Though not restrictive in any way, such a manner of voltage supply is advantageous as will become apparent.

Now, when a DC constant voltage is applied to the electrodes 206 and 208, toner particles in the developer undergo electrophoresis and this develops an electrodeposition current. The sensor measures this current. During the measurement, the toner particles adhere to the electrode 206. The other electrode 208 is also deposited with substances other than the toner and the amount of these deposits increases in accordance with the fatigue of the developer. However, the amount of deposition on the electrode 208 is usually small compared with the amount of toner adhered to the electrode 206. The toner particles on the electrode 206 tend to jel.

Figure 9B:
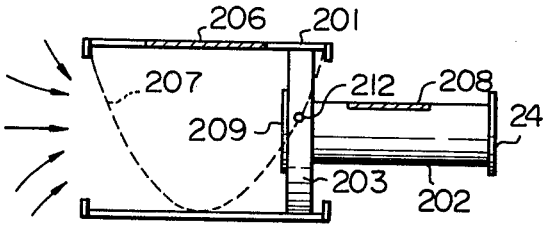

Then, the inner cylinder 202 is moved to the right relative to the outer cylinder 201 to a position shown in FIG. 9*b*. This movement is naturally caused by the shaft 204. The voltage supply to the electrodes 206 and 208 is cut off at a suitable time. During this movement, the left flange 209 of the inner cylinder 202 abuts against the left end of the slide ring 203 and shifts it rightward together with the inner cylinder 202. This axial movement of the slide ring 203 is accompanied by rotary motion due to the engagement of the pin 212 on the slide ring 203 in the guide channel 207 in the outer cylinder 201. The slide ring 203 moving leftward while rotating scrapes the inner wall of the outer cylinder 201 and thereby removes or cleans the toner particles from the electrode 206. Furthermore, the slide ring 203 during this rightward movement forces the developer out of the measuring section in FIG. 9*a* which is the space between the inner and outer cylinders 201 and 202 and, at the same time, introduces another volume of developer into the bore of the outer cylinder 201 from the left end thereof.

Figure 9C:
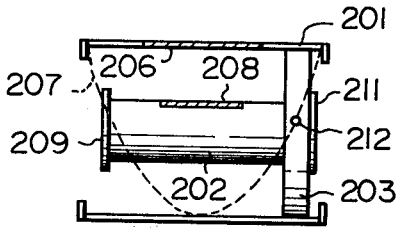

Next, the inner cylinder 202 is shifted to the left to a position shown in FIG. 9*c*. The pin 212 engaged in the guide channel 207 acts as a stop on the slide ring 203 and prevents it from axial movement. Thus moving relative to the slide ring 203, the inner cylinder 202 has its outer periphery scraped by the slide ring 203 and therefore its electrode 208 cleaned.

The electrodes 206 and 208 now regain their home position and perform another measurement of the eletrodeposition current.

During the process described above, the inner cylinder 202 has reciprocated once in the region rightwardly of the home position and this reciprocation has cleaned the inner periphery of the outer cylinder 201 and outer periphery of the inner cylinder 202.

Figure 9D:
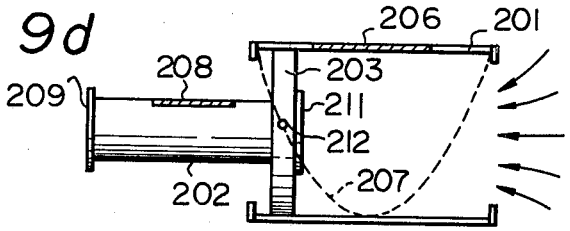
Figure 9E:
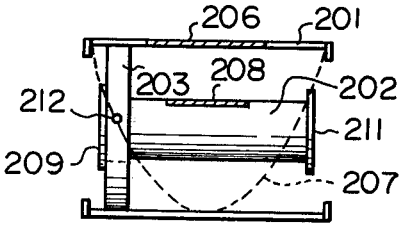

After the measurement in the position of FIG. 9c, the inner cylinder 202 and slide ring 203 are moved leftward integrally to a position shown in FIG. 9d and then only the inner cylinder 202 is shifted to the right to a position shown in FIG. 9e. This reciprocation of the inner cylinder 202 in the region leftwardly of the home position cleans the electrodes 206 and 208 again. After this reciprocation, the movable components resume the measuring positions depicted in FIG. 9a.

In this way, electrodes 206 and 208 are cleaned after each repetitive measuring action so that the deposition current may be measured stably over a long period of time by using a DC voltage regardless of the deposition of toner particles on the electrodes 206 and 208.

The measurement may be effected either by temporarily stopping the movement of the inner cylinder 202 or by causing it to move constantly. In the case of constant reciprocation of the inner cylinder 202, a voltage having a given period will be applied to the electrodes 206 and 208 when the electrode 208 moves past the home position relative to the electrode 206.

While the illustrated sensor, the slide ring 203 cleans the electrode 208 when moving relative to the outer cylinder 201 and cleans the electrode 208 when moving relative to the inner cylinder 202. It is only the movement of the slide ring 203 relative to the outer cylinder 201 which is accompanied by a rotary motion of the slide ring 203. The cleaning effect obtainable with the slide ring 203 is relatively large on the electrode 201 and relatively small on the electrode 202. It follows that, by applying a voltage to the electrodes 206 and 208 such that toner particles adhere to the electrode 206, the deposits removed through the cleaning effect of the slide ring 203 may be further enhanced.

FIGS. 10a to 10d illustrate another embodiment of the present invention.

Referring to FIGS. 10a to 10d, an outer cylinder 201' formed with the electrode 206 is dimensioned slightly longer than the outer cylinder 201 of the first embodiment and provided with a radially inward stop or shoulder 218 in a portion of its inner periphery somewhat closer to the left end than to the right end. The outer cylinder 201' is immersed in the developer and securely mounted on a rigid member.

A slide ring 203' is similar to the slide ring 203 but void of the pin 212. The outer cylinder 201' does not have the guide channel 207 accordingly.

Tension springs 219 are anchored at one end to the left end of the outer cylinder 201' and at the other end to the left end of the slide ring 203'. In the positions shown in FIGS. 10a and 10b, the springs 219 keep the slide ring 203' abutted against the shoulder or stop 218 on the outer cylinder 201'.

Figure 10A:
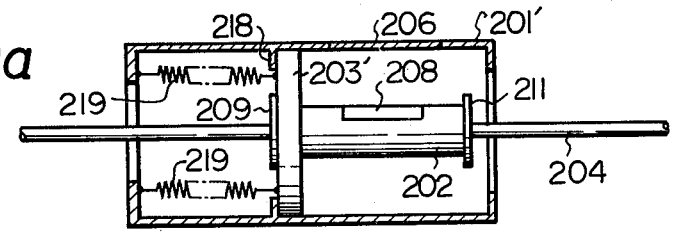
FIGS. 10*a*, 10*b*, 10*c*, and 10*d* are elevational views illustrating the operation of a modified sensor.
Figure 10B:
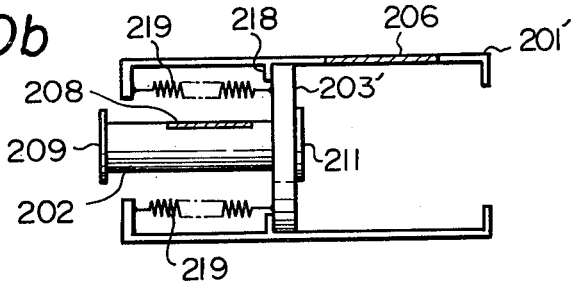
Figure 10C:
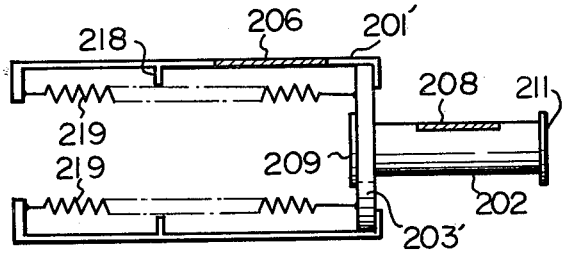

FIG. 10a represents a measuring position of the sensor in which a DC voltage is applied across the electrodes 206 and 208 to measure the electrodeposition current in the developer. After the measurement, the shaft 204 is shifted to the left until the inner cylinder 202 assumes the position of FIG. 10b. During this movement, the outer periphery of the inner cylinder 201' is scraped by the slide ring 203' for cleaning the electrode 206. Then, the inner cylinder 202 is moved to the right while shifting the slide ring 203' integrally therewith by means of the flange 209 up to the right end of the outer cylinder 201'. This position is illustrated in FIG. 10c. Moving to the right, the slide ring 203' cleans the electrode 206 by scraping the inner periphery of the outer cylinder 201', and at the same time, re-cleans the electrode 206 due to the movement of the inner cylinder 202 relative to the slide ring 203'. The rightward movement as the slide ring 203' also serves to drive the developer out of the measuring section.

Figure 10D:
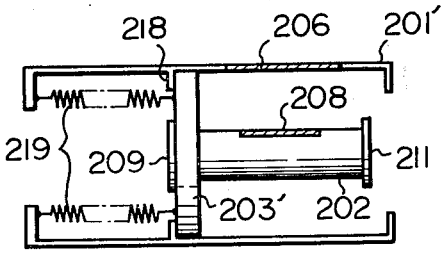

Thereafter, the slide ring 203' and inner cylinder 202 are integrally displaced to the left by the action of the springs 219 until the position of FIG. 10d is reached. The position of FIG. 10d is the measuring position common to that of FIG. 10a. The slide ring 203' moving leftward sucks a fresh volume of developer into the measuring section and permits another measurement. During the shift of the sensor from the position of FIG. 10c to the position of FIG. 10d, the slide ring 203' again cleans the electrode 206 on the outer cylinder 201'.

The inner cylinder 202 reciprocates twice, once in the region leftwardly of the home position and once in the other region rightwardly of the same. During an intermeasurement period the electrodes 206 and 208 are cleaned by these two reciprocations of the inner cylinder 202. Though the movement of the slide ring 203' is translation and does not involve rotation, the cleaning effect obtainable therewith is comparable with that of the sensor shown in FIG. 7 by virtue of the two cleaning operations during the interval between first and second measurements. The voltage supply to the electrodes 206 and 208 may be carried out in any desired way. Concerning the measurement efficiency for continuous measurement, the sensor of FIG. 7 is superior to the sensor of FIGS. 10a to 10d since it can perform a measurement for every reciprocation of the inner cylinder 202.

While the outer cylinder 201' has been shown and described as being stationary and the inner cylinder 202 movable relative to the stationary outer cylinder 201', it will be understood that the inner cylinder 202 may be stationary and the outer cylinder 201' movable.

The construction and operation of the piston type sensor will have become clear from the above description.

Figure 18:
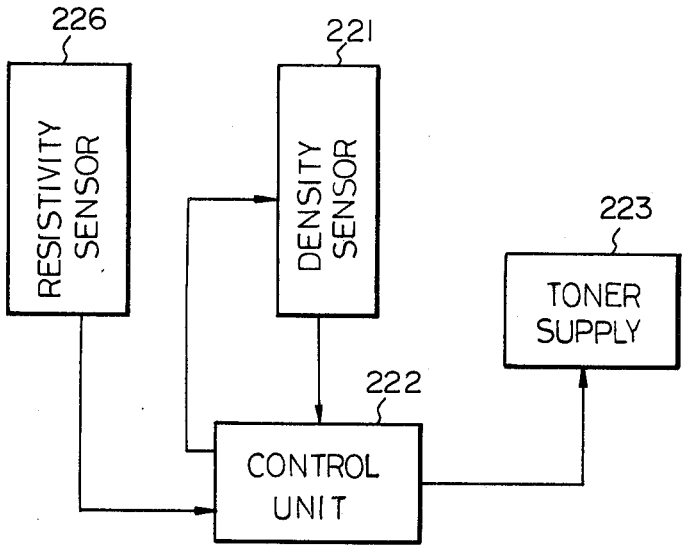
FIG. 18 is a block diagram illustrating the operation of the invention.

FIG. 18 is a block diagram showing a toner density control method according to the present invention. The method will be outlined taking for example a case wherein the transmissibility range is varied at every 10,000 copying cycles.

First, the upper and lower operating limits of the light receiving element of a density sensor 221 are set to those for a fresh developing liquid. Then a toner and carried are supplied to the developing unit to prepare a liquid developer of a proper toner density based on the upper and lower operating limits of the light receiving element. The toner supply is carried out while activating the sensor 221, a control unit 222 and a toner supply unit 223. A piston type resistivity sensor 226 measures the electrodeposition current in the thus prepared developer using a DC current. The control unit 222 stores the result of the measurement.

Until the 10,000th copying cycle is reached, the toner density is controlled on the basis of the upper and lower limits of the operating range such that the entire toner density $\rho_T$ in the developer, which is $\rho_e+\rho_u$, remains within a predetermined range. As the 10,000th copying cycle is completed, the electrodeposition current is measured again and the result of this measurement is compared with the current value stored in the unit 222 to determine the amount of change in the current. According to this amount of change in the current, a new operating range of the light receiving element of the sensor 221 is determined so that the light receiving element has new upper and lower limits. Thereafter, until the 20,000th copying cycle is reached, the toner density is controlled according to the re-set transmissibility range such that the total toner density in the developer remains within the new predetermined range.

At the 20,000th copying cycle, the operating range of the light receiving element will be again altered in the same way.

In this instance, how much the operating range of the light receiving element is to be altered according to the fluctuation in the electrodeposition current is predetermined through experiments and stored in advance in the unit 222.

Figure 19:
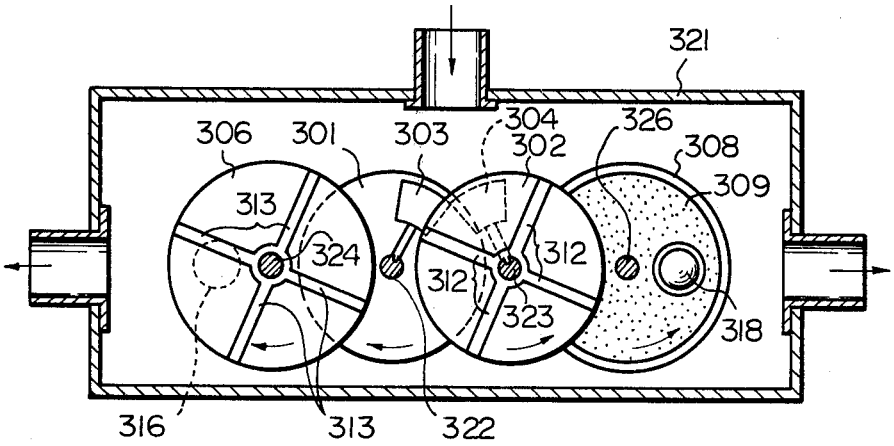
FIG. 19 is an elevational view of another sensor of the invention.
Figure 20:
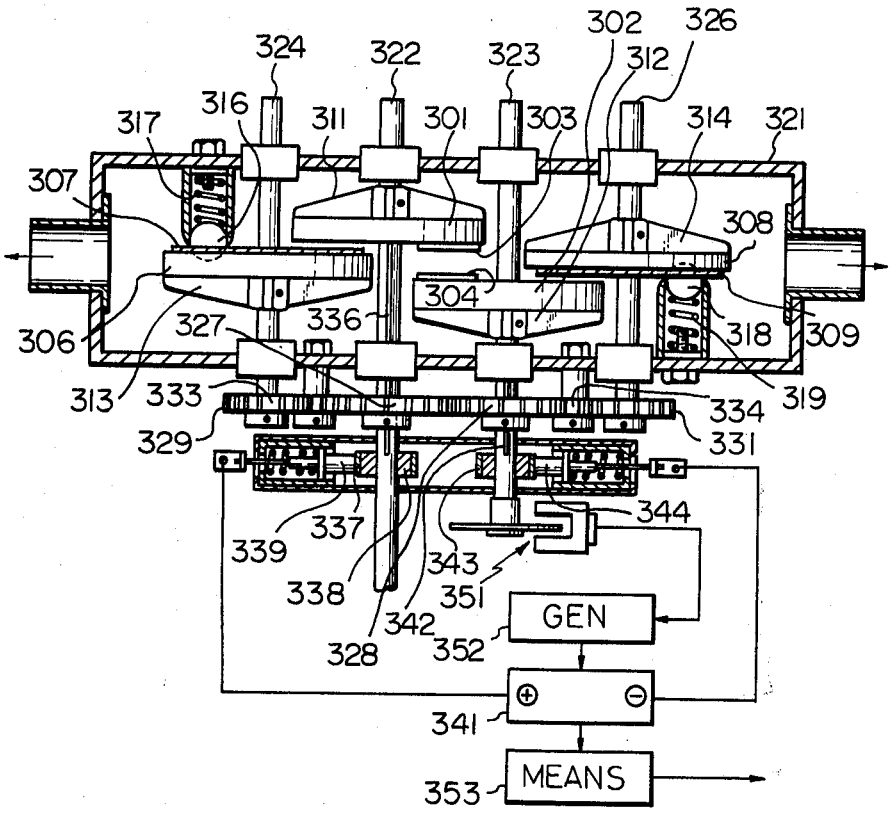
FIG. 20 is a plan view of the sensor of FIG. 19.
Figure 21:
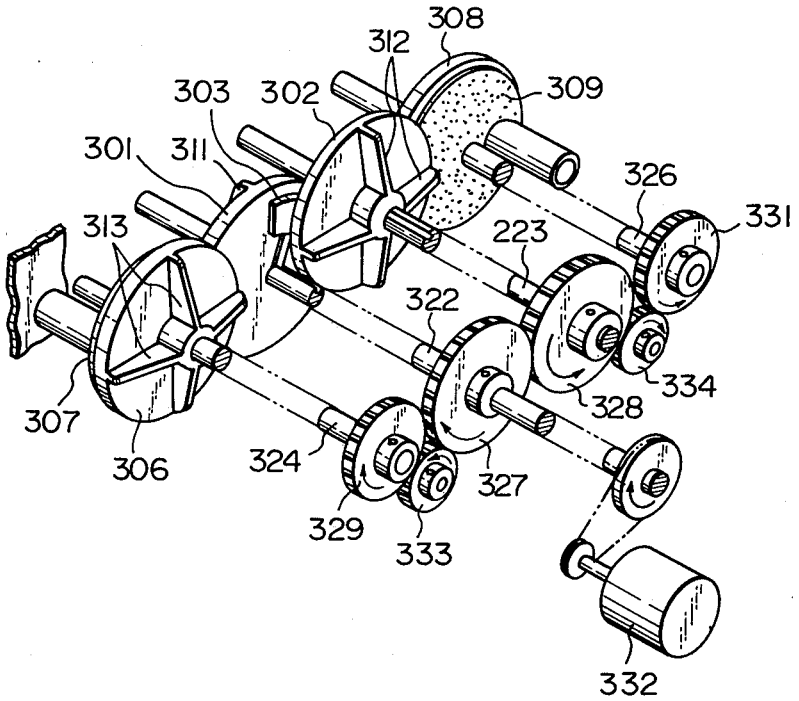
FIG. 21 is an exploded view of the sensor of FIG. 19.

Another embodiment of the invention is shown in FIGS. 19 to 21.

Referring to FIGS. 19 and 21, a resistivity sensor according to the present invention is shown to include a first electrode disc 301 and a second electrode disc 302 which are spaced a given distance from each other and face each other at their limited marginal areas. Sectoral electrode blocks 303 and 304 are embedded individually in the discs 301 and 302. Located at a common distance from the centers of rotation of the associated discs 301 and 302, the eletrodes 303 and 304 are connected to the positive terminal and negative terminal of a voltage source, respectively.

A part of the disc 301 having the electrode 303 is confronted by a part of an adjacent scraper or cleaning disc 306. A cleaning member 307 is carried on one axial end of the cleaning disc 306 and protrudes slightly therefrom in the axial direction. This cleaning member 307 is formed of a flexible material such as sponge rubber and adapted to scrape the surface of the electrode 303 as will be described below. Likewise, a second scraper or cleaning disc 308 neighbors and partly faces the disc 302 with the electrode 304 carried thereon and has a cleaning member 309 of the same material as the cleaning member 307.

Fins or blades 311 and 312 extend radially from the other axial ends of the discs 301 and 302 in order to stir the liquid developer. Similarly, stirring blades 313 and 314 extend radially from the other axial ends of the individual cleaning discs 306 and 308. The blades on each of the four discs also function as ribs for reinforcing the discs. The discs 301 and 302 are made of an electrically insulating material such as polyacetal, polyethylene or Teflon (trade name).

In FIG. 20, a steel ball or like presser element 316 bites into the yieldable member 307 on the cleaning disc 306 under the force of a compression spring 317. Likewise, a presser element 318 is pressed against the yieldable member 309 on the other cleaning disc 308 by a spring 319. These discs 301, 302, 306 and 308 are accommodated in a common housing 321.

As best shown in FIG. 21, the discs 301, 302, 306 and 308 are individually mounted on shafts 322, 323, 324 and 326. Also mounted on these shafts 322 to 326 are gears 327, 328, 329 and 331. The shaft 322 constitutes a power input shaft of the assembly and is in driven connection with a drive source in the form of a motor 332. Rotation of the motor 332 is transmitted to the shafts 322 to 326 through the gears 327 to 331 and idler gears 333 and 334 so that the discs 301, 302, 306 and 308 rotate as indicated by arrows in FIG. 19.

As shown in FIG. 20, an axial groove 336 extends along the shaft 322 and receives a lead wire (not shown) therein. The lead wire is connected at one end to the electrode 303 on the disc 301 and at the other end with a copper ring 337 rigid on the periphery of an insulator ring 338 which is in turn rigid on the shaft 322. A brush 339 made of carbon or graphite for instance is held in contact with the periphery of the copper ring 337 and connected to the positive terminal of a DC voltage source 341. The electrode 303 on the disc 301 is therefore connected to the positive terminal of the voltage source 341 by way of the conductive members mentioned.

Similarly, the electrode 304 on the disc 302 is connected to one end of a lead wire embedded in an axial groove 342 on the shaft 323 and in turn connected to a copper ring 343. A brush 344 engages with the copper ring 343 and connects to the negative terminal of the DC voltage source 341. These conductive members thus connect the electrode 304 on the disc 302 to the negative terminal of the voltage source 341.

For measurement of electrodeposition current, the housing 321 of the apparatus may be dipped in the liquid developer stored in a developing tank or the liquid developer may be introduced into the housing 321 from the tank by way of suitable piping. Driven by the motor 332, the individual discs 301, 302, 306 and 308 rotate as indicated by arrows so that their blades stir the developer inside the housing 321 and admit and discharge developer to prevent it from staying within the container 321.

The electordes 303 and 304 will face each other in the course of each rotation of the first and second discs 301 and 302. At this time, the DC voltage source 341 supplies a DC constant current across the electrodes 303 and 304. FIG. 20 shows an example of means for applying the voltage just when the electrodes 303 and 304 come to face each other. This means comprises a synchronizing signal generator 351 typified by a pulse generator or a magnetic switch, and a timing signal circuit 352. An output signal of the synchronizing signal generator 351 is processed by the timing signal circuit 352 for amplification and other operations and coupled therefrom to the DC voltage source 341. The electrodeposition current flowing through the developer is measured by a measuring unit 353.

More specifically, when a DC constant voltage is applied to the electrodes 303 and 304, the resultant electric field between the electrodes 303 and 304 causes electrophoresis of the toner in the developer and thereby produces an electrodeposition current in the developer. This current is measured by the unit 353 as mentioned. Toner particles are deposited on one of the electrodes 303 and 304 due to the difference in polarity. The other electrode 303 or 304 will be deposited with other substances, but the amount of these deposits is generally small compared with the toner deposition on said one electrode.

In any case, the amount of deposits on the electrodes 303 and 304 increase with the fatigue of the developer and create a cause of an error in measurement when the electrodeposition current is to be measured with a DC voltage applied across the electrodes 303 and 304. Thus, the fatigue of the developer fails to be measured with accuracy over a long time of service.

According to the present invention, the adjacent discs 301 and 306 rotate in the same direction while the electrode 303 on the disc 301 moves in contact with the yieldable cleaning member 307. Thus, the member 307 scrapes the electrode 303 surface to remove the deposited toner particles therefrom. Likewise, the cleaning member 309 on the disc 308 removes toner particles from the corresponding electrode 304 on the disc 302 during rotation of the discs 302 and 308 which occurs in the same direction. Since each electrode is cleaned every time the corresponding disc performs one full rotation, that is, every time measurement is effective, it remains clean despite a long time of continuous measurement. This permits the apparatus to continuously measure the electrodeposition current and therefore the fatigue of the developer with excellent accuracy. If desired, the supply of the DC voltage to the electrodes may be performed not at every rotation of the electrode carrying discs but at every several rotations of the same.

The presser members 316 and 318 cause the associated cleaning members 307 and 309 to repeatedly contract and expand whereby the toner electrically desposited on the cleaning members 307 and 309 is separated therefrom and dispersed back into the developer. The electrodes 303 and 304 on the discs 301 and 302 may be replaced by electrodes in the form of rings embedded in the confronting ends of the discs 301 and 302 with a common diameter. In this case, a DC voltage will be applied intermittently across the ring electrodes which constantly face each other at limited protions. It will be understood, however, that the electrodes 303 and 304 in the form of blocks as illustrated are more favorable regarding the cleaning efficiency and voltage application efficiency because they have a relatively small area which must be cleaned.

Since the discs shown in FIG. 19 serve only to measure the electrodeposition current and clean the electrodes, relatively small diameters suffice which aids in a decrease in the size of the container 321. Accordingly, such a measuring unit can be installed in the developing tank without needing a disproportionate space.

It will be appreciated from the foregoing that the present invention provides an electrodeposition current measuring apparatus which is operable with a DC voltage over a long time in a continuous manner, simple in structure and compact in design.

In summary, it will be seen that the present invention overcomes the drawbacks of the prior art and provides an electrostatic copying apparatus featuring constant copying image density over a prolonged period of operation in an automatic manner. Various modifications will become possible possible for those skilled in the art after receiving the teachings of the present disclosure without departing from the scope thereof.

What is claimed is:

1. An electrostatic copying apparatus including container means for containing a liquid developer having a liquid carrier and toner particles despersed in the carrier, characterized by comprising: first sensor means for sensing an electrical resistivity of the developer; second sensor means for sensing an optical transmissibility of the developer; supply means for supplying additional toner particles into the developer; and control means responsive to the first and second sensor means for controlling the supply means to supply additional toner into the developer in such a manner as to maintain the transmissibility at a value which is a predetermined function of the resistivity.

2. An apparatus as in claim 1, in which the control means is constructed to reduce said value as the resistivity increases.

3. An apparatus as in claim 1, in which the control means is constructed to control the supply means in an intermittent manner.

4. An apparatus as in claim 1, in which the control means is constructed to control the supply means in a continuous manner.

5. An apparatus as in claim 1, in which the first sensor means comprises a first electrode, a second electrode, and power source means for applying an A.C. voltage across the first and second electrodes.

6. An apparatus as in claim 5, in which the first sensor means further comprises scraper means for scraping accumulated toner off the first and second electrodes and actuator means for producing relative scraping movement between the scraper means and the first and second electrodes.

7. An apparatus as in claim 6, in which the first sensor means further comprises first and second electrode discs, the first and second electrodes being provided on the first and second electrode discs respectively, the scraper means comprising first and second scraper discs which scrapingly engage with the first and second electrode discs respectively, the actuator means being constructed to rotate the first and second electrode discs and the first and second scraper discs for relative scraping movement.

8. An apparatus as in claim 7, in which the first and second electrode discs are provided with fins for stirring the developer.

9. An apparatus as in claim 7, in which the first and second scraper discs are provided with fins for stirring the developer.

10. An apparatus as in claim 7, in which the first and second scraper discs comprise resilient materials which scrapingly engage with the first and second electrode discs respectively, the first sensor means further comprising first and second presser members for pressingly engaging with the resilient materials on the first and second scraper discs causing the resilient materials to alternatingly be resiliently compressed and expanded and thereby shake accumulated toner particles away therefrom.

11. An apparatus as in claim 5, in which the first sensor means comprises an outer tube, the first electrode being provided on an inner surface of the outer tube, an inner tube provided coaxially inside the outer tube for axial movement relative thereto, the second electrode being provided on an outer surface of the inner tube, the scraper means comprising a scraper ring slidingly and scrapingly disposed between the inner and outer tubes, opposite ends of the inner tube being formed with stops for abutment with the scraper ring, the actuator means being constructed to reciprocate the inner tube.

12. An apparatus as in claim 11, in which the inner surface of the outer tube is formed with a spiral groove, the scraper ring being provided with a pin which fits in the groove.

13. An apparatus as in claim 11, in which the outer tube is formed with a stop the first sensor means further comprising a spring for urging the scraper ring toward abutment with the stop.

* * * * *